US006495511B2

(12) United States Patent
Kitching

(10) Patent No.: US 6,495,511 B2
(45) Date of Patent: Dec. 17, 2002

(54) PROCESS FOR TREATING BENTONITE AND PRODUCTS THEREOF

(75) Inventor: Peter Jeffrey Kitching, Winsford (GB)

(73) Assignee: Colin Stewart Minchem, Ltd. (GB)

( * ) Notice: Subject to any disclaimer, the term of this patent is extended or adjusted under 35 U.S.C. 154(b) by 0 days.

(21) Appl. No.: 09/761,007

(22) Filed: Jan. 16, 2001

(65) Prior Publication Data

US 2002/0169100 A1 Nov. 14, 2002

Related U.S. Application Data

(63) Continuation of application No. PCT/GB99/02394, filed on Jul. 16, 1999.

(30) Foreign Application Priority Data

Jul. 17, 1998 (GB) ..... 9815450

(51) Int. Cl.[7] ..... C11D 3/12
(52) U.S. Cl. ..... 510/507; 502/80
(58) Field of Search ..... 510/507; 502/80

(56) References Cited

U.S. PATENT DOCUMENTS

| | | | | |
|---|---|---|---|---|
| 3,914,384 A | | 10/1975 | Gullett | |
| 4,483,934 A | | 11/1984 | Goodman et al. | |
| 5,084,428 A | | 1/1992 | Suzuki et al. | |
| 5,114,893 A | | 5/1992 | Hughes | |
| 5,773,408 A | * | 6/1998 | Trinh et al. | 510/520 |
| 5,775,259 A | * | 7/1998 | Tucker | 119/173 |
| 6,110,886 A | * | 8/2000 | Scepanski | 510/515 |

FOREIGN PATENT DOCUMENTS

| | | |
|---|---|---|
| FR | 2 498 586 | 1/1982 |
| GB | 1 468 482 | 3/1977 |
| GB | 2 095 274 | 9/1982 |
| JP | 05-263359 | 10/1993 |

* cited by examiner

*Primary Examiner*—John Hardee
(74) *Attorney, Agent, or Firm*—Reed Smith LLP; Michael I. Wolfson

(57) ABSTRACT

A process for treating a bentonite having a montmorillonite content of at least 85% which, when activated with sodium ions dried and ground, does not swell more than about 2.5-fold when gradually added to deionised water at room temperature and when crushed dried and calcined to an LoI of less than 4% at 190° C. absorbs 16 to 22% by weight of water in a controlled environment at 25° C. and a relative humidity of 40% by weight, which process comprises the following steps in the following order: i) drying to a moisture content from 25 to 35% by weight; ii) conditioning by crushing, mixing and/or extruding; iii) addition of water to form an extrudable paste having a moisture content of 25 to 40% by weight; iv) extrusion through a die preferably from 4 to 10 mm in diameter; v) drying to a moisture content from 10 to 14% by weight; vi) calcining at 120 to 250° C. to an LoI of less than 4% at 190° C.; and vii) reduction to particles.

6 Claims, No Drawings

PROCESS FOR TREATING BENTONITE AND PRODUCTS THEREOF

CROSS REFERENCE TO RELATED APPLICATIONS

This application is a continuation of PCT application PCT/GB99/02394, filed on Jul. 16, 1999 which claims priority of application GB 9815450, filed on Jul. 17, 1998.

BACKGROUND OF THE INVENTION

This invention relates to a process for treating a bentonite and a bentonite treated by the process that is suitable for use as a softener in soaps, laundry bars, and other detergent compositions for fabrics.

Bentonites which are colloidal aluminum silicates have previously been proposed as softeners for detergents based on their swelling and ion exchange properties. However, in general, bentonites form a gel on contact with water and the presence of the gel on the surface of the bentonite particles tends to prevent penetration of water into the particles and hence inhibits dispersion of the bentonite material.

The process of this invention differs from traditional processes for treating bentonite in that traditional processes seek to retain the high gelling and high swelling properties of the starting material. If these properties are retained, when bentonite particles make contact with water a gel is formed at the water/bentonite interface which acts as a barrier to further water penetration into the interior of the particle. This is known as "gel blocking". As a result of gel blocking, the bentonite particles have to remain in contact with water for many hours before penetration of the water into the particles and complete gelling of the bentonite is achieved. For this reason measurements of gelling are not normally carried out on bentonite until it has been in contact with water for around 24 hours. The purpose of the invention, on the other hand, is to degrade the gelling and swelling properties of the original starting material with the result that the particles disperse very rapidly in water without gel blocking and this makes the material particularly suitable for use as a softener.

In more detail, bentonite consists of platelets of aluminosilicate spaced apart and held together by metal cations. The structure already contains some water of crystallisation between the platelets. If the bentonite is heated to such a high temperature that this initial water is driven off, the bentonite largely loses its ability to re-absorb water and therefore to swell and gel.

The process of the present invention breaks down the original structure of the bentonite whilst driving off the initial water, so that the bentonite loses its ability to swell and gel. The original platelets however remain and these are the basis for the softening properties. Thus, when the treated bentonite material according to the invention is introduced into water there is little or no gelling but instead the particles rapidly disintegrate and disperse.

U.S. Pat. No. 4,483,934 discloses a method of beneficiating (i.e. purifying) bentonite in which a liquid suspension of the bentonite is subjected to shear to bring about homogenisation but there is no attempt to degrade the original structure and it is clear that the product retains its gelling properties.

U.S. Pat. No. 5,114,893 describes a method of treating a bentonite with the purpose of increasing its water absorption and water-swellable properties.

GB-1468482 describes a method of treating montmorillonite which involves drying the material at a temperature well below that required to drive off the initial water.

FR-2498586 describes a method of treating bentonite which, although involving extrusion of a bentonite paste, results in a product which retains its gelling properties in water.

SUMMARY OF THE INVENTION

The present invention provides a process for obtaining a treated bentonite by selecting an initial bentonite starting material with relatively low gelling and swelling properties, drying this at a sufficiently high temperature substantially to drive off its initial water content, and extruding the resulting material under high shear conditions in the form of a paste so as further to degrade its initial structure.

This process, involving the treatment of a bentonite raw material having a specific composition and specific properties, results in a bentonite product having a reduced tendency to gel on contact with water so that when used in detergent compositions such as laundry formulations it improves dispersion without reducing the softening properties.

More preferably according to the invention we provide a process for treating a bentonite having a montmorillonite content of at least 85% which, when activated with sodium ions dried and ground, does not swell more than about 2.5-fold when gradually added to deionised water at room temperature and when crushed dried and calcined to an LoI of less than 4% at 190° C. absorbs 16 to 22% by weight of water in a controlled environment at 250° C. and a relative humidity of 40% by weight, which process comprises the following steps in the following order:

(i) drying to a moisture content from 25 to 35% by weight;

(ii) conditioning by crushing, mixing and/or extruding;

(iii) addition of water to form an extrudable paste having a moisture content of 25 to 40% by weight;

(iv) extrusion through a die preferably from 4 to 10 mm in diameter;

(v) drying to a moisture content from 10 to 14% by weight;

(vi) calcining at 120 to 250° C. to an LoI of less than 4% at 190° C.; and (vii) reduction to particles.

The conditioning step involves working the material so that it becomes extrudable.

DETAILS DESCRIPTION OF THE PREFERRED EMBODIMENT

The starting material is a low swelling and low gelling bentonite preferably comprising at least 85%, and preferably at least 95% by weight, of montmorillonite. It preferably shows by XRF analysis at least 4.0% and more preferably at least 5.0% magnesium oxide, and yet more preferably has a chemical composition by weight as follows:

| | |
|---|---|
| SiO2 | 55.0–61.0% |
| A1203 | 14.5–17.6% |
| Fe203 | 1.45–1.7% |
| CaO | 2.8–7.0% |
| MgO | 5.0–6.3% |
| K2O | 0.5–0.85% |
| Na20 | 0.25–0.30% |
| Mn304 | 0.04–0.25% |
| LOI at 1025° C. | 9.0–18.6% |

It may also contain small proportions of other minerals.

One particular bentonite suitable for use in the invention has the following chemical composition by weight:

| | |
|---|---|
| SiO2 | 58.13% |
| A1203 | 15.78% |
| Fe203 | 1.58% |
| CaO | 4.26% |
| MgO | 5.60% |
| K2O | 0.70% |
| Na20 | 0.24% |
| Mn304 | 0.07% |
| BaO | 0.02% |
| SrO | 0.02 |
| LoI at 1025° C. | 12.97% |
| | 99.37% |

"LoI" means "loss of ignition" and is the percentage reduction in the initial weight upon calcining to constant weight at the specified temperature.

In order to confirm suitability for use in the invention a sample of the bentonite starting material made into a 28% w/w slurry in deionised water may be activated with sodium carbonate at a level calculated to give optimum swelling, dried at 50° C. to a moisture content from 8 to 14% by weight, then ground so that at least 90% of the particles are not greater than 75 microns in diameter. The resulting material is then gradually added to deionised water at room temperature and if suitable should not swell more than about 2.5-fold. For example, if 2 g of the resulting material is added very gradually to 100 ml of deionised water at room temperature in a 100 ml measuring cylinder, it should not swell to more than 16 ml over 24 hours.

Further, the bentonite raw material, when crushed, dried and calcined at a temperature from 120 to 250° C. so that at 190° C. it showed an LoI of less than 4% by weight, should absorb from 16 to 22% water by weight when placed in a controlled environment for 12 hours at 250° C. and having a relative humidity of 40%.

Preferably the calcining step is at a temperature of 150 to 250° C.

Preferably, the bentonite raw material is air dried to a moisture content of about 30%. Preferably, it is then conditioned by being ground and crushed (e.g. in a pan mill) and extruded through slots or holes 10 to 20 mm in diameter, prior to the addition of water and the extrusion step which is preferably performed in a pelleting mill or other extruder.

The invention also provides treated bentonites obtained by the process defined above, and detergent compositions containing them.

EXAMPLE

A typical detergent formulation containing a treated bentonite in accordance with the invention as a softening agent is as follows:

Amongst other ingredients

Less than 5% w/w:

Cationic Surfactants,

Nonionic Surfactants

Enzymes (if Biological) and Brightening Agents

5–20% w/w:

Anionic Surfactants

Treated Bentonite

Bleaching Agents

15–30% w/w

Phosphates or Zeolites

What is claimed is:

1. A process for treating a bentonite having a montmorillonite content of at least 85% which, when activated with sodium ions dried and ground, does not swell more than about 2.5-fold when gradually added to deionised water at room temperature and when crushed dried and calcined to an LoI of less than 4% at 190° C. absorbs 16 to 22% by weight of water in a controlled environment at 25° C. and a relative humidity of 40% by weight, which process comprises the following steps in the following order:

(i) drying the bentonite to a moisture content from 25 to 35% by weight;

(ii) conditioning by crushing, mixing and/or extruding;

(iii) addition of water to form an extrudable paste having a moisture content of 25 to 40% by weight;

(iv) extrusion through a die preferably from 4 to 10 mm in diameter;

(v) drying to a moisture content from 10 to 14% by weight;

(vi) calcining at 120 to 250° C. to an LoI of less than 4% at 190° C.; and (vii) reduction to particles.

2. A process according to claim 1, wherein in step (i) the bentonite is air dried to a moisture content of about 30%.

3. The process according to claim 2, wherein step (ii) the bentonite is ground and forced through an opening 10 to 22 mm in diameter.

4. A process according to claim 1 wherein in step (ii) the dried bentonite raw material is ground and forced through an opening 10 to 22 mm in diameter.

5. A process according to any preceding claim 1 wherein the bentonite starting material contains at least 4.0% by weight of MgO.

6. A process according to claim 1 wherein the bentonite starting material has the following composition by weight:

| | |
|---|---|
| SiO2 | 55.0–61.0% |
| A1203 | 14.5–17.6% |
| Fe2O3 | 1.45–1.7% |
| CaO | 2.8–7.0% |
| MgO | 5.0–6.3% |
| K2O | 0.5–0.85% |
| Na20 | 0.25–0.30% |
| Mn304 | 0.04–0.25% |
| LOI at 1025° C. | 9.0–18.6% |

* * * * *